US012414664B2

(12) United States Patent
Howard et al.

(10) Patent No.: US 12,414,664 B2
(45) Date of Patent: Sep. 16, 2025

(54) SMART NOZZLE AND A SURFACE CLEANING DEVICE IMPLEMENTING SAME

(71) Applicant: SharkNinja Operating, LLC, Needham, MA (US)

(72) Inventors: Damian Howard, Winchester, MA (US); Andre D. Brown, Natick, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 16/926,604

(22) Filed: Jul. 10, 2020

(65) Prior Publication Data

US 2021/0007569 A1 Jan. 14, 2021

Related U.S. Application Data

(60) Provisional application No. 62/872,862, filed on Jul. 11, 2019.

(51) Int. Cl.

| | |
|---|---|
| ***A47L 9/28*** | (2006.01) |
| ***A47L 5/26*** | (2006.01) |
| ***A47L 9/04*** | (2006.01) |

(52) U.S. Cl.

CPC ..... *A47L 9/2847* (2013.01); *A47L 5/26* (2013.01); *A47L 9/0411* (2013.01); (Continued)

(58) Field of Classification Search

CPC ..... A47L 9/2847; A47L 9/0477; A47L 9/282; A47L 9/2826; A47L 9/2831; (Continued)

(56) References Cited

U.S. PATENT DOCUMENTS

| | | | |
|---|---|---|---|
| 5,014,386 | A | 5/1991 | Worwag |
| 5,155,885 | A | 10/1992 | Jyouraku et al. |

(Continued)

FOREIGN PATENT DOCUMENTS

| | | |
|---|---|---|
| DE | 19855101 | 6/2000 |
| EP | 3954264 | 2/2022 |

(Continued)

OTHER PUBLICATIONS

Chinese Office Action with English translation issued Jul. 7, 2022, received in Chinese Patent Application No. 202080050634.1, 37 pages.

(Continued)

*Primary Examiner* — Makena S Markman

(74) *Attorney, Agent, or Firm* — Grossman Tucker Perreault & Pfleger, PLLC

(57) ABSTRACT

In general, the present disclosure is directed to nozzle control circuitry for use in surface cleaning devices that preferably reduces overall power consumption of a surface cleaning device by detecting the start of a cleaning operation by a user before energizing one or more components such as an agitator. The nozzle control circuitry can detect a cleaning operation based on data output from one or more sensors (also referred to herein as operation sensors). For example, the nozzle control circuitry can communicate with at least one of a motion sensor such as an accelerometer, an orientation sensor such as gyroscope, and/or an air pressure sensor operatively coupled within a dirty air inlet to detect the presence of generated suction.

13 Claims, 8 Drawing Sheets

(52) U.S. Cl.
CPC ..... *A47L 9/0477* (2013.01); *A47L 9/2821* (2013.01); *A47L 9/2826* (2013.01); *A47L 9/2831* (2013.01); *A47L 9/2842* (2013.01); *A47L 9/2884* (2013.01)

(58) Field of Classification Search
CPC ..... A47L 9/2842; A47L 9/2884; A47L 5/26; A47L 9/2868; A47L 9/02; A47L 9/0411; A47L 9/0461; A47L 9/0488; A47L 5/24; A47L 5/30; A47L 9/2878
USPC ..... 15/319
See application file for complete search history.

(56) References Cited

U.S. PATENT DOCUMENTS 5,722,109 A * 3/1998 Delmas ..... A47L 9/2894 15/412
5,881,430 A * 3/1999 Driessen ..... A47L 9/2847 15/319
7,113,847 B2 9/2006 Chmura et al.
7,578,025 B2 8/2009 Kostreba et al.
7,765,638 B2 * 8/2010 Pineschi ..... A47L 9/0411 15/387
8,452,450 B2 * 5/2013 Dooley ..... B60L 53/14 901/46
9,510,715 B2 12/2016 Van Den Bogert
9,629,514 B2 4/2017 Hillen et al.
9,993,129 B2 6/2018 Santini
2002/0108204 A1 * 8/2002 Buss ..... A47L 11/4027 15/353
2005/0055792 A1 3/2005 Kisela et al.
2005/0065662 A1 3/2005 Reindle et al.
2005/0278888 A1 * 12/2005 Reindle ..... A47L 9/2857 15/319
2006/0085095 A1 * 4/2006 Reindle ..... A47L 9/2821 700/258
2007/0266520 A1 11/2007 Bosses
2008/0053479 A1 3/2008 Worwag
2008/0209667 A1 * 9/2008 Allen ..... A47L 5/14 15/346
2010/0050373 A1 3/2010 Kaffenberger et al.
2012/0152280 A1 * 6/2012 Bosses ..... A47L 9/2805 134/6
2012/0317743 A1 12/2012 Reed et al.
2013/0058635 A1 3/2013 Vrdoljak
2013/0152337 A1 6/2013 Thorne
2014/0150201 A1 6/2014 McGee et al.
2014/0223688 A1 8/2014 Reindle et al.
2015/0013102 A1 1/2015 Bilger
2015/0040340 A1 2/2015 Bilger et al.
2015/0135474 A1 5/2015 Gidwell
2015/0297054 A1 10/2015 Weeks et al.
2015/0351596 A1 12/2015 Thorne
2016/0128530 A1 5/2016 Thorne et al.
2016/0174787 A1 6/2016 Conrad
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0309973 A1 10/2016 Sheikh et al.
2016/0324388 A1 11/2016 Vrdoljak et al.
2016/0374533 A1 12/2016 Innes et al.
2017/0000305 A1 1/2017 Gordon et al.
2017/0042319 A1 2/2017 Conrad et al.
2017/0049288 A1 2/2017 Knutson et al.
2017/0112343 A1 4/2017 Innes et al.
2017/0127896 A1 5/2017 Carter et al.
2017/0144810 A1 5/2017 Birdsell
2017/0215667 A1 8/2017 Thorne et al.
2017/0347848 A1 12/2017 Carter et al.
2017/0369032 A1 12/2017 Hill et al.
2018/0035854 A1 * 2/2018 Thorne ..... A47L 9/2884
2018/0050634 A1 * 2/2018 White ..... A47L 7/0085
2018/0064301 A1 3/2018 Cottrell et al.
2018/0068815 A1 3/2018 Cottrell
2018/0070785 A1 3/2018 Udy et al.
2018/0249875 A1 * 9/2018 Hooley ..... A47L 9/2821
2018/0255991 A1 9/2018 Der Marderosian et al.
2018/0255997 A1 * 9/2018 So ..... B25J 9/1664
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0117031 A1 4/2019 Xie
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0302793 A1 10/2019 Leech et al.
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2019/0387942 A1 * 12/2019 Truitt ..... A47L 9/0411
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0037833 A1 2/2020 Niedzwecki et al.
2020/0037843 A1 2/2020 Fiebig et al.
2020/0046184 A1 2/2020 Freese et al.
2020/0077855 A1 3/2020 Brown et al.
2020/0085267 A1 3/2020 Thorne et al.
2020/0085269 A1 3/2020 Thorne
2020/0121144 A1 4/2020 Gacin et al.
2020/0121148 A1 4/2020 Hoffman et al.
2020/0138260 A1 5/2020 Sutter et al.
2020/0154968 A1 * 5/2020 Terry ..... A47L 9/2847
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0237171 A1 7/2020 Xu et al.
2020/0288929 A1 9/2020 Brunner
2020/0288930 A1 9/2020 Wells
2020/0297172 A1 9/2020 Tonderys et al.
2020/0301430 A1 9/2020 Irkliy et al.
2020/0315418 A1 10/2020 Howard et al.
2020/0345196 A1 11/2020 Innes et al.
2020/0367711 A1 11/2020 Thorne et al.
2020/0371526 A1 11/2020 Kamada
2020/0383547 A1 12/2020 Sutter et al.
2021/0007569 A1 1/2021 Howard et al.
2021/0022574 A1 1/2021 Harting
2021/0030227 A1 2/2021 Mathieu et al.
2021/0038032 A1 2/2021 Brown
2021/0059495 A1 3/2021 Gill et al.
2021/0085144 A1 3/2021 Woodrow et al.
2021/0169289 A1 6/2021 Thorne et al.
2021/0175772 A1 6/2021 Aini
2021/0177223 A1 6/2021 Der Marderosian et al.
2021/0186282 A1 6/2021 Mathieu et al.
2021/0204684 A1 7/2021 Heman-Ackah et al.
2021/0254615 A1 8/2021 Vrdoljak et al.
2021/0307581 A1 10/2021 Thorne et al.
2021/0315428 A1 10/2021 Udy et al.
2021/0386261 A1 12/2021 Woodrow et al.
2021/0386262 A1 12/2021 Uchendu et al.
2022/0031131 A1 2/2022 McClay et al.
2022/0031133 A1 2/2022 Der Marderosian et al.
2022/0031134 A1 2/2022 Yang et al.
2022/0061614 A1 3/2022 Yu et al.

(56) References Cited

U.S. PATENT DOCUMENTS

| | | | | |
|---|---|---|---|---|
| 2022/0071459 | A1 | 3/2022 | Gacin et al. | |
| 2022/0095864 | A1 | 3/2022 | Der Marderosian et al. | |
| 2022/0125256 | A1 | 4/2022 | Lessard et al. | |
| 2022/0354327 | A1* | 11/2022 | Kim | H02J 50/005 |
| 2023/0248192 | A1 | 8/2023 | Brown et al. | |

FOREIGN PATENT DOCUMENTS

| | | | |
|---|---|---|---|
| JP | S61238221 | | 10/1986 |
| JP | 2003339601 | A * | 12/2003 |
| JP | 2012055462 | | 3/2012 |
| JP | 2015154850 | | 8/2015 |
| JP | 2015156900 | | 9/2015 |
| JP | 2018094021 | | 6/2018 |
| WO | 2008099584 | | 8/2008 |
| WO | 2015179980 | | 12/2015 |
| WO | 2018161011 | | 9/2018 |

OTHER PUBLICATIONS

Chinese Office Action with English Summary issued Jan. 20, 2023, received in Chinese Patent Application No. 202080050634.1, 15 pages.

Japanese Office Action with English machine translation issued Mar. 14, 2023 received in Japanese Patent Application No. 2022-501312, 15 pages.

Japanese Office Action with machine-generated English translation issued Oct. 3, 2023, received in Japanese Patent Application No. 2022-501312, 9 pages.

Extended European Search Report issued Nov. 21, 2023, received in European Patent Application No. 20837213.6, 13 pages.

European Office Action dated Nov. 15, 2024, received in European Patent Application No. 20837213.6, 32 pages.

PCT Search Report and Written Opinion, mailed Oct. 14, 2020, received in corresponding PCT Application No. PCT/US20/41724, 14 pages.

* cited by examiner

SMART NOZZLE AND A SURFACE CLEANING DEVICE IMPLEMENTING SAME

CROSS-REFERENCE TO RELATED APPLICATIONS

This application claims the benefit of U.S. Provisional Patent Application Ser. No. 62/872,862, filed on Jul. 11, 2019, which is fully incorporated herein by reference.

TECHNICAL FIELD

This specification relates to surface cleaning apparatuses, and more particularly, to a surface cleaning device with nozzle control circuitry that can detect usage of the surface cleaning device by a user and activate nozzle components such as a brushroll/agitator, and preferably to adjust brushroll speed, direction of rotation, and/or nozzle orientation relative to a floor type detected proximate the nozzle.

BACKGROUND INFORMATION

Powered surface cleaning devices, such as vacuum cleaners, have multiple components that each receive electrical power from one or more power sources (e.g., one or more batteries or electrical mains). For example, a vacuum cleaner may include a suction motor to generate a vacuum within a cleaning head. The generated vacuum collects debris from a surface to be cleaned and deposits the debris, for example, in a debris collector. The vacuum may also include a motor to rotate a brushroll within the cleaning head. The rotation of the brushroll agitates debris that has adhered to the surface to be cleaned such that the generated vacuum is capable of removing the debris from the surface. In addition to electrical components for cleaning, the vacuum cleaner may include one or more light sources to illuminate an area to be cleaned.

Portable surface cleaning devices, such as hand-held vacuums, are generally more convenient than "corded" vacuums that couple to AC mains. However, one drawback to portable vacuum cleaners is that their power source, e.g., one or more rechargeable battery cells, allow for relatively limited amounts of cleaning time before recharging is necessary. Accessories such as brushrolls increase cleaning performance in some applications such as the cleaning of carpeted surfaces, upholstery, etc., but motors that drive brushrolls can consume significant power during use, and in particular, when the brushrolls are under load such as is the case when cleaning thick carpets and other high-friction surfaces. Accordingly, some hand-held surface cleaning devices do not include nozzles with brushrolls, while others offer removable brushrolls that a user can remove or otherwise disable to extend battery life.

BRIEF DESCRIPTION OF THE DRAWINGS

The drawings included herewith are for illustrating various examples of articles, methods, and apparatuses of the teaching of the present specification and are not intended to limit the scope of what is taught in any way.

DETAILED DESCRIPTION

Figure 1:
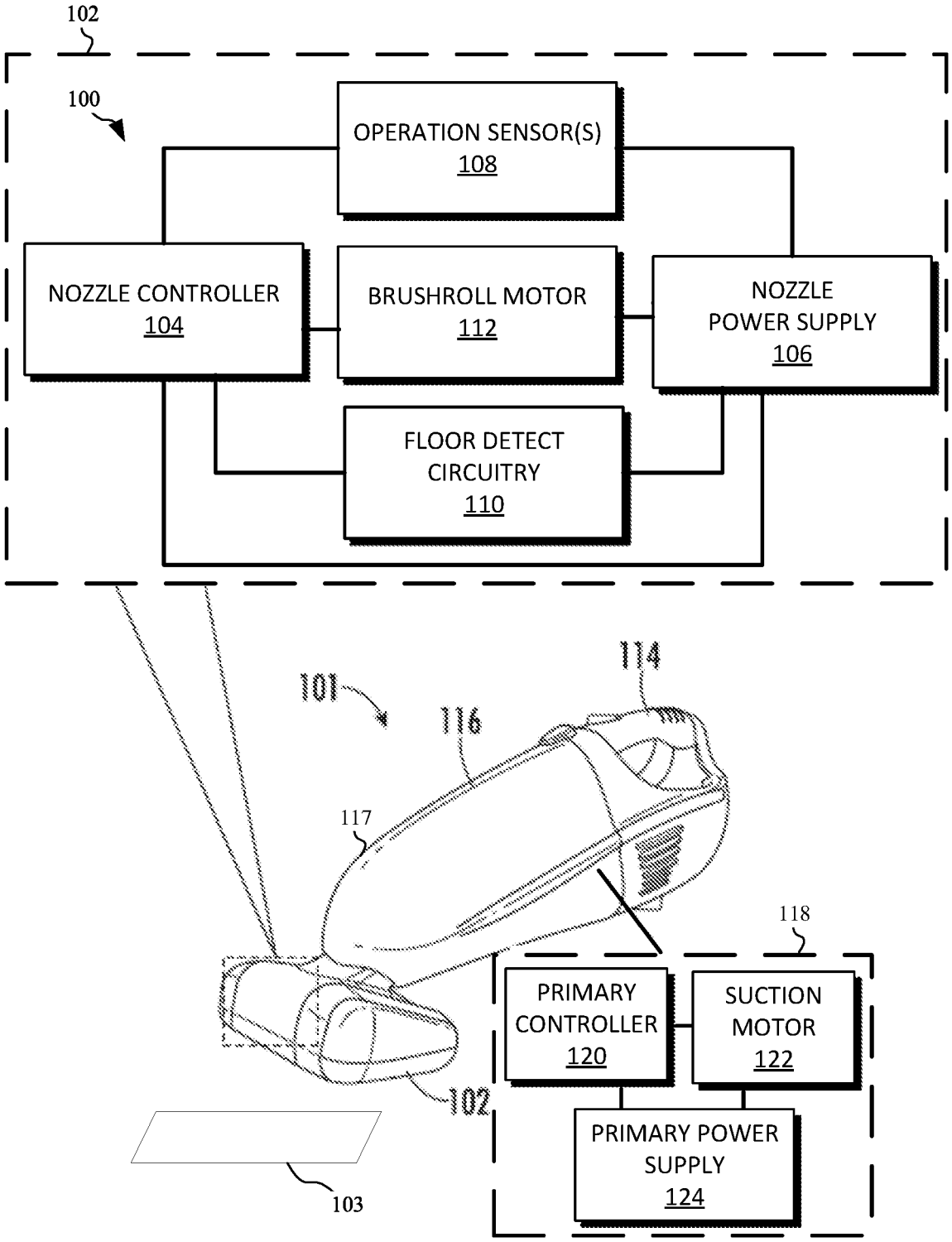
FIG. 1 shows an example surface cleaning device that includes nozzle control circuitry consistent with embodiments of the present disclosure.

In general, the present disclosure is directed to nozzle control circuitry (also referred to herein as nozzle circuitry) for use in surface cleaning devices that preferably reduces overall power consumption of a surface cleaning device by detecting the start of a cleaning operation by a user before energizing one or more components such as an agitator. The nozzle control circuitry can detect a cleaning operation based on data output from one or more sensors (also referred to herein as operation sensors). For example, the nozzle control circuitry can communicate with at least one of a motion sensor such as an accelerometer, an orientation sensor such as gyroscope, and/or an air pressure sensor operatively coupled within a dirty air inlet to detect the presence of generated suction.

Preferably, the nozzle control circuitry and one or more operation sensors are disposed or otherwise integrated into a removable nozzle housing (or attachment housing) such that the removable nozzle housing can be selectively coupled to a surface cleaning device and operate without necessarily communicating electrically and/or physically with other components of the surface cleaning device. The nozzle control circuitry also preferably detects the end of a cleaning operation using one or more of the aforementioned operation sensors and can de-energize power to one or more associated components such as an agitator without necessarily requiring user input, e.g., a button press.

In more detail, the nozzle control circuitry preferably includes one or more power supplies (e.g., battery cell(s), and preferably rechargeable battery cells), a controller (also referred to herein as a nozzle controller or nozzle microcontroller), and operation sensor(s) collocated within/on a nozzle housing to implement a nozzle control scheme that can enable, adjust, and disable brushroll action and/or other nozzle-based components (e.g., LED status lights, side brushes, nozzle angle/height adjuster, and so on) without the necessity of receiving user input (e.g., button input) or having electrical communication between the nozzle control circuitry and the circuitry controlling the suction motor, for example.

The nozzle control scheme preferably operates in a relatively low-power mode to detect usage of the surface cleaning device by momentarily powering a nozzle controller and one or more operation sensors (e.g., gyroscope, accelerometer, magnetometer, pressure sensor) to detect usage of a surface cleaning device by comparing sensor data to associated predefined thresholds, for example. Once usage/operation of the surface cleaning device is detected, the nozzle control circuitry can preferably transition to a relatively high-power, in-use mode to, for instance, drive brushroll motor(s) to vary RPMs of a brushroll/agitator based on a detected floor type, and select from predefined RPM values as the nozzle encounters different detected floor types. The nozzle control circuitry then preferably automatically transitions back to the low-power mode after the same detects cleaning operations have ended, e.g., based on sensor data measuring below predefined thresholds for a predefined period of time. The transition to the low-power mode preferably includes the nozzle control circuitry de-energizing the brushroll motor and/or related components and then returning to a sequence that can include momentarily energizing the nozzle controller and operation sensor(s), as discussed above, until subsequent usage is detected.

Accordingly, nozzle control circuitry consistent with the present disclosure can preferably perform relatively low-power, coarse-grain sampling of sensor data and intelligently transition to a relatively high-power mode of operation, generally referred to herein as an in-use mode, that can include brushroll action, activation of optional side brushes, enabling an LED to increase visibility within a surrounding environment, diagnostic output (e.g., battery charge level via LEDs), deployment of a cleaning solution, height adjustment of brushroll/agitator, and/or clog detection.

Preferably, the nozzle control circuitry can perform relatively fine-grain detection of surface types while in the in-use mode to ensure optimal cleaning operation, e.g., through adjusting RPM of brushroll(s), deployment of a cleaning solution, and/or alerting a user to a detected clog condition. Stated differently, the nozzle control circuitry can adjust to surface-type changes in a timely fashion, e.g., within 1-3 seconds, and preferably within 1 second, to ensure optimal cleaning.

In addition, the nozzle control circuitry is preferably implemented within a single nozzle housing thus eliminating the necessity of wires/interconnects to electrically couple the nozzle control circuitry to circuitry governing suction motor operation, for instance. This increases aesthetic appeal of a surface cleaning device by eliminating wires/interconnects, and allows for the nozzle control circuitry to operate in an independent fashion. In cases where the nozzle includes one or more batteries, overall battery life of a surface cleaning device can be extended as the nozzle components can draw power from the nozzle batteries rather than from a primary power source such as batteries that are configured to power a suction motor and associated circuitry.

In one specific non-limiting example embodiment, a removable nozzle housing can further include an agitator motor and one or more brushrolls. The removable nozzle housing may then be coupled to a nozzle coupling section of a surface cleaning device when agitator-assisted cleaning is desired. The nozzle control circuitry within the removable nozzle housing may then detect the initiation of a cleaning operation and energize the agitator motor without requiring additional user input, e.g., a button press. More preferably, the removable nozzle housing includes an integrated power supply such as one or more battery cells to power the nozzle control circuitry and/or associated components such as the agitator motor and associated brushroll(s) to avoid adding load to the primary power source of the surface cleaning device, e.g., the power source used to power a suction motor. The removable nozzle housing may then be stored separate from the surface cleaning device, and in addition, optionally allow for charging of the integrated power supply within the removable nozzle housing via a dock or other suitable device such as a power adapter coupled to AC mains.

As generally referred to herein, dust and debris refers to dirt, dust, water, and/or any other particle that may be pulled by suction into a surface cleaning device.

Turning to the Figures, FIG. 1 illustrates an example surface cleaning device 101 that implements nozzle control circuitry 100 consistent with the present disclosure. The embodiment of FIG. 1 illustrates the surface cleaning device 101 as a hand-held surface cleaning device, and therefore, the following disclosure may also refer to the surface cleaning device 101 as a hand-held vacuum or hand-held surface cleaning device. However, other types of surface cleaning devices can implement aspects and embodiments of the nozzle control circuitry 100 disclosed herein such as so-called stick vacs, robotic vacuums, or any other device that seeks to intelligently engage brushrolls and/or adjust operating modes of a nozzle to optimize cleaning performance and/or extend battery life.

As shown, the surface cleaning device 101 includes a handle portion (or handle) 114, body (or base) 116, and a nozzle 102. The body 116 includes a removable dust cup 117 for receiving and storing dirt and debris. The body 116 can fluidly couple with the nozzle 102 to receive dirt and debris for storage within the removable dust cup 117.

The handle portion (or handle) 114 preferably includes a shape/profile contoured to a user's hand to reduce wrist fatigue during use. Preferably, one or more user interface buttons adjacent the handle portion 114 permit ON/OFF of a suction motor, and removal of the removable dust cup 117 for purposes of emptying dirt and debris, for example. The handle portion 114 transitions to the body 116, with the body 116 providing a cavity to house the removable dust cup 117, optional filter, and vacuum controller circuitry 118.

Preferably, the vacuum controller circuitry 118 includes a primary controller 120, suction motor 122, and primary power supply 124. Each component of the vacuum controller circuitry 118 resides within the body 116, e.g., each component is collocated within the body 116, although the components can reside in different locations, e.g., within the handle portion, additional housing sections, and so on, depending on a desired configuration. The primary controller 120 includes circuitry such as a microcontroller, application-specific integrated circuit (ASIC), and/or discrete circuitry, logic, memory and chips. Likewise, the primary controller 120 can perform methods as variously described herein using hardware (e.g., a processor, ASIC, circuitry), software (e.g., computer-readable code compiled or interpreted from assembly code, C++ code, C code, or an interpreted language such as Java), or any combination thereof.

The primary controller 120 further includes circuitry to provide a driving signal to cause the suction motor 122 to turn ON/OFF and increase/decrease suction during cleaning operations. This circuitry can include, for instance, a motor driving circuit, power conversion circuitry, speed regulators, and so on. The suction motor 122 can comprise a DC motor or other suitable device for generating suction. In operation, the suction motor 122 can thus generate suction to draw air into an inlet of the nozzle 102.

The primary controller 120 and the suction motor 122 each draw power from the primary power supply 124. The primary power supply 124 can include one or more battery cells, and preferably rechargeable battery cells such as rechargeable lithium ion battery cells, and associated circuitry such as DC-DC converters, voltage regulators and current limiters.

Continuing on, the nozzle 102 is preferably configured to removably couple to the body 116. The nozzle 102 preferably defines a dirty air passageway, and a dirty air inlet fluidly coupled to the dirty air passageway. Preferably, the nozzle 102 includes one or more brush rolls (not shown), and the nozzle control circuitry 100 disposed thereon, such as shown in FIG. 1.

The nozzle control circuitry 100 preferably includes a nozzle controller 104, a nozzle power supply 106, operation sensor(s) 108, optional floor detect circuitry 110, and a brushroll motor 112. Preferably, the optional floor detect circuitry 110 comprises at least one floor type sensor (also referred to herein as a floor type detector).

The nozzle controller 104, which may also be referred to as a secondary controller, can be implemented as a microprocessor, ASIC, circuitry, software instructions, or any combination thereof. Note, while the nozzle controller 104 is shown as a separate and distinct component from that of the primary controller 120, the nozzle controller 104 may be implemented whole, or in part, by the primary controller 120.

The nozzle power supply 106 can include one or more battery cells, and preferably one or more rechargeable battery cells and associated circuitry. The nozzle power supply 106 may also be referred to as secondary power supply. Preferably, the nozzle control circuitry 100 is electrically isolated from the vacuum controller circuitry 118. In this preferred example, no direct (e.g., a wire or other interconnect) extends across/within the surface cleaning device 101 to provide electrical communication between the vacuum controller circuitry 118 and nozzle control circuitry 100. Stated differently, the nozzle control circuitry 100 and the vacuum controller circuitry 118 can operate independent of each other and can utilize dedicated power supplies such that the primary power supply gets dedicated to the components of the nozzle. Likewise, the primary power supply 124 can primarily power the vacuum control components, to the exclusion of the nozzle control circuitry 100.

Preferably, each of the nozzle control circuitry 100 and the vacuum controller circuitry 118 therefore include separate and distinct power supplies, e.g., nozzle power supply 106 and the primary power supply 124, respectively. The primary power supply 124 can include a different number and/or type of battery cells than the nozzle power supply 106. For instance, space constraints of the nozzle 102 relative to the body 116 can result in more/larger capacity battery cells implemented within the primary power supply 124 relative to the nozzle power supply 106.

Likewise, the nozzle control circuitry 100 and the vacuum controller circuitry 118 preferably include separate external electrical contacts (not shown) for charging purposes. Thus, the nozzle 102 can be optionally decoupled and charged separately from the surface cleaning device 101, and the surface cleaning device 101 can continue to be used for cleaning operations that do not necessarily require brushrolls/nozzle features. Alternatively, or in addition, the surface cleaning device 101 can couple to a docking station (not shown) with electrical contacts/mating connectors for the nozzle 102 and the body 116 such that the primary power supply 124 and nozzle power supply 106 can be charged simultaneously and/or sequentially by the same charging circuit.

In an embodiment, the nozzle control circuitry 100 and the vacuum controller circuitry 118 are electrically coupled, e.g., via wires or other electrical interconnect. Thus, in this embodiment, the vacuum controller circuitry 118 may utilize power from the nozzle power supply in addition to the primary power supply to increase operational time for cleaning, or the surface cleaning device 101 can include a single power supply, e.g., primary power supply 124, such that both the nozzle control circuitry 100 and the vacuum controller circuitry 118 utilize the same power supply.

The operation sensor(s) 108 can include one or more sensors disposed on/in the nozzle 102. For example, the operation sensor(s) 108 can include any sensor capable of sensing user-supplied pressure/force such as a strain gauge or other force sensor configured to measure the force of the nozzle 102 against the surface to be cleaned 103, and/or any sensor capable of detecting suction force. Preferably, the nozzle 102 can include an air pressure sensor disposed along a dirty air passageway defined by the same to detect suction generated by the suction motor 122 and output a proportional electrical signal. In any such cases, the nozzle controller 104 may then receive output (also referred to herein as output data) from the operation sensor(s) 108 to detect usage of the surface cleaning device 101.

Alternatively, or in addition, the operation sensor(s) 108 can include an accelerometer, gyroscope, and/or magnetometer. In this example, the operation sensor(s) 108 may therefore include a motion sensing arrangement. The operation sensor(s) 108 can therefore detect acceleration of the surface cleaning device 101, the direction of that movement (along 2 or more axis such as X, Y and Z), and/or the orientation of the nozzle, e.g., roll, pitch and yaw to determine an angle/orientation a user holds the surface cleaning device 101 relative to the surface to be cleaned. The operation sensor(s) 108 may then output data such as one or more signals with values representing the acceleration and orientation data in real-time or on a periodic basis depending on a desired sample rate. For example, the operation sensor(s) 108 can output data that indicates the surface cleaning device 101 is angled substantially transverse relative to a surface to be cleaned 103 (e.g., as shown in FIG. 1). The nozzle controller 104 may then detect usage of the surface cleaning device 101 based on such output data from the operation sensor(s) 108.

Preferably, at least one of the operation sensor(s) 108 operates in a low-power mode whereby the at least one operation sensor operating in the low-power mode can be used to detect threshold events before utilizing relatively high-power sensors, increasing sample rates from the operation sensor(s), and/or energizing nozzle components such as the brushroll motor 112. For instance, the operation sensor(s) 108 can include a motion sensor (e.g., an accelerometer or other acceleration sensor) or motion sensor arrangement (e.g., gyroscope, accelerometer, and/or magnetometer) and periodically sample acceleration data in a low-resolution manner, e.g., once per second, to detect movement of the surface cleaning device 101 by a user during the low-power mode. In the event the sampled acceleration data exceeds a predefined threshold value over a period of time T, the nozzle controller 104 may then transition to a normal or "in-use" mode, whereby a driving signal is provided to the brushroll motor 112 to cause the same to rotate one or more brush rolls during cleaning, and/or another cleaning mode is activated such as side brush activation. Alternatively, or in addition, the driving signal may also cause cleaning fluid to be dispensed from a cleaning fluid reservoir (not shown) disposed in the body 116 or the nozzle 102.

Preferably, the in-use mode can also include activating one or more light sources disposed on the surface cleaning device 101 to increase visibility, e.g., one or more headlamp bulbs, LEDs, and/or power diagnostic lights such as LEDs that can indicate charge levels of the nozzle power supply 106 and/or the primary power supply 124, error conditions, clogs restricting inlet airflow into nozzle 102, filter change reminders, or other operating conditions.

Alternatively, or in addition, pressure measurements from the operation sensor(s) 108 can be utilized to validate or otherwise detect the surface cleaning device 101 is in use by a user. For instance, the nozzle 102 being pressed against a surface to be cleaned can trigger a pressure/force measurement value output by the operation sensor(s) 108 that can be used alone or in combination with movement data by the nozzle controller 104 to transition to the in-use mode. For example, a force measurement that exceeds a first predefined threshold may then trigger a suction measurement by an air pressure sensor. In this example, the nozzle controller 104 may then transition to the in-use mode based on the suction measurement exceeding an associated predefined threshold. More preferably, the operation sensor(s) 108 include one or more sensors within or adjacent the dirty air inlet 105 of the nozzle 102 to detect suction levels, and based on those measured levels exceeding a threshold, the nozzle control circuitry 100 and more particularly the nozzle controller 104 can transition to the in-use mode.

Therefore, in view of the foregoing, the nozzle control circuitry 100 preferably utilizes a low-power mode or "standby" mode whereby sampling is performed in a relatively coarse-grain fashion using low-resolution sampling or low-power sensors, or both, to reduce power consumption and extend battery life. The nozzle control circuitry 100 can then transition to the in-use mode during cleaning operations, e.g., to provide brushroll action, dispense cleaning fluid, provide illumination to aid in cleaning operations, and/or display operational status to a user, and then preferably detect the end of a cleaning operation based on pressure measurements and/or motion data (or a lack thereof) to transition back to the low-power mode, e.g., to conserve power. Thus, from a user's perspective the surface cleaning device 101 automatically detects that such nozzle features are desired by a user's natural motions, the presence of suction being generated by the suction motor 122, and/or by the orientation the user is holding the surface cleaning device 101 relative to the surface to be cleaned 103 during cleaning operations, and when such nozzle features can be automatically disabled, e.g., to conserve power.

One example method for transitioning between a standby/sleep mode for the nozzle control circuitry 100 and the in-use mode is as follows. Initially when the surface cleaning device moves, e.g., based on a user gripping the handle portion 114 and moving surface cleaning device 101, an accelerometer or other motion sensor of the operation sensor(s) 108 sends a signal to a transistor switching circuit (not shown) of the nozzle control circuitry 100. The transistor switching circuit then causes the nozzle controller 104 to momentarily energize. More preferably, the transistor switching circuit also causes a light or other light source of the surface cleaning device 101 to also energize and provide illumination during cleaning operations without necessarily energizing other components such as the brushroll motor 112.

Preferably, the energized nozzle controller 104 then receives output data from at least one air pressure sensor of the operation sensor(s) 108 to determine if the output value exceeds a predefined threshold, and thus, if the surface cleaning device 101 is ON and in use by a user. Stated differently, the energized nozzle controller 104 can utilize a pressure sensor within the nozzle 102 to detect the presence of suction generated by the suction motor 122.

Preferably, the nozzle 102 removably couples to the body 116 such that the nozzle 102 and operation sensor(s) 108 remain coupled together when the nozzle 102 is decoupled from the body 116 of the surface cleaning device 101. More preferably, at least the nozzle 102, the operation sensor(s) 108, and the brushroll motor 112 remain coupled together when the nozzle 102 is decoupled from the body of the surface cleaning device 101.

In response to the energized nozzle controller 104 determining the surface cleaning device 101 is ON, e.g., in use, the nozzle controller 104 then transitions to the in-use mode. The nozzle controller 104 can then optionally cause one or more of the headlamp(s), diagnostic LEDs, and brushroll motor 112 to switchably energize and turn ON. While ON, the nozzle controller 104 preferably periodically receives output data from the operation sensor(s) 108 to detect continued use via, for example, acceleration, orientation of the surface cleaning device, and/or measured pressure (e.g., suction). During the in-use mode, the nozzle controller 104 preferably utilizes a motion sensor of the operation sensor(s) 108, such as an accelerometer, and floor detect circuitry 110 to control the brush motor mode/RPM relative to the detected floor type, as discussed in greater detail below.

Preferably, the nozzle controller 104 samples output data of the pressure sensor of the operation sensor(s) 108 to determine if the output data indicates the surface cleaning device 101 remains in use, e.g., based on comparing the output data to a predetermined threshold. More preferably, the nozzle controller 104 preferably continuously samples the pressure sensor, e.g., every 50 ms to 1000 ms, and preferably every 500 ms, to determine if the current pressure level indicates the surface cleaning device 101 is in use. Thus, in response to air pressure values and/or acceleration measurements falling below the predefined threshold for a predefined period of time (e.g., 1-20 seconds, and preferably 2-3 seconds), the transistor switching circuit of the nozzle control circuitry 100 switches "low" to turn off/de-energize the nozzle controller 104, the brushroll motor 112, and/or other components of the nozzle control circuitry 100 such as the floor detect circuitry, to transition the same to the low-power/standby mode.

In an embodiment, the nozzle controller 104 can use output data from the operation sensor(s) 108 and floor detect circuitry 110 to control the brush motor RPMs. One such example method for dynamically controlling the brush motor mode/RPM based on a detected floor type is discussed further below with reference to FIG. 2.

Smart Nozzle Architecture and Methodologies

Figure 6:
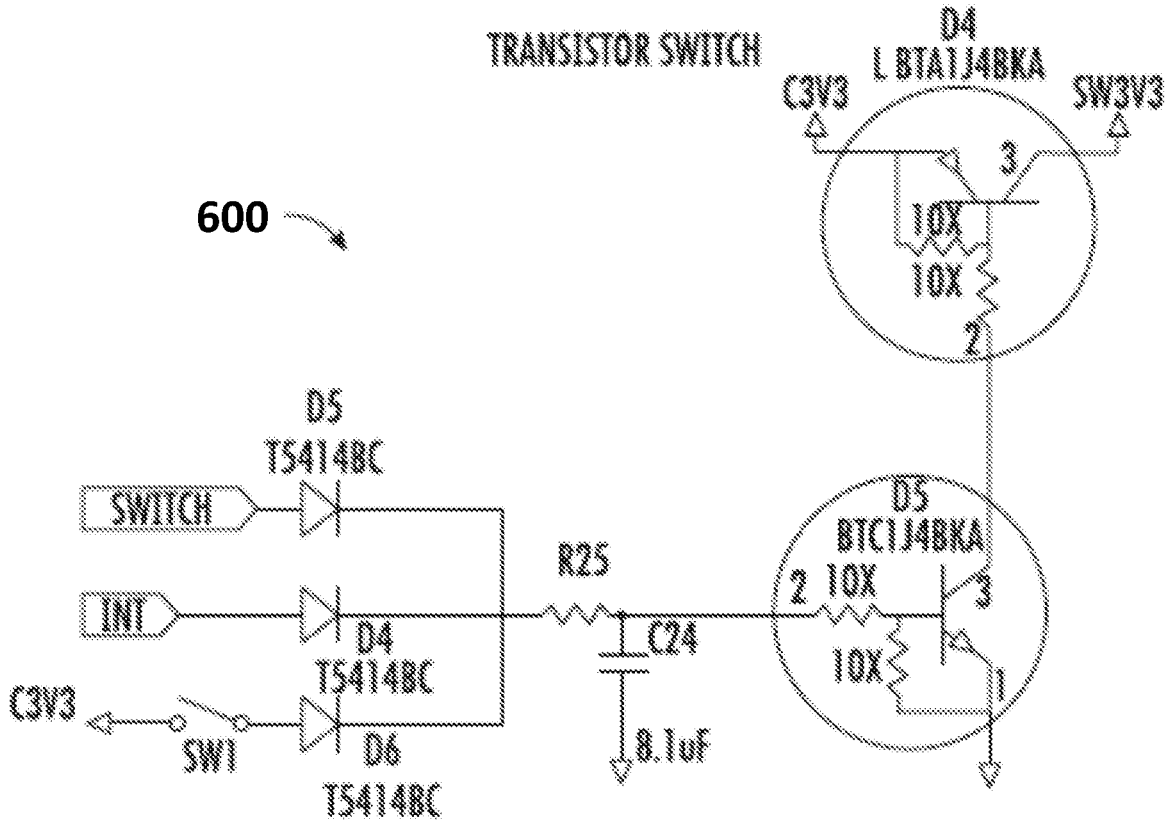
FIG. 6 shows an example circuit diagram for a transistor switching circuit suitable for use in the nozzle control circuitry of FIG. 1.
Figure 7:
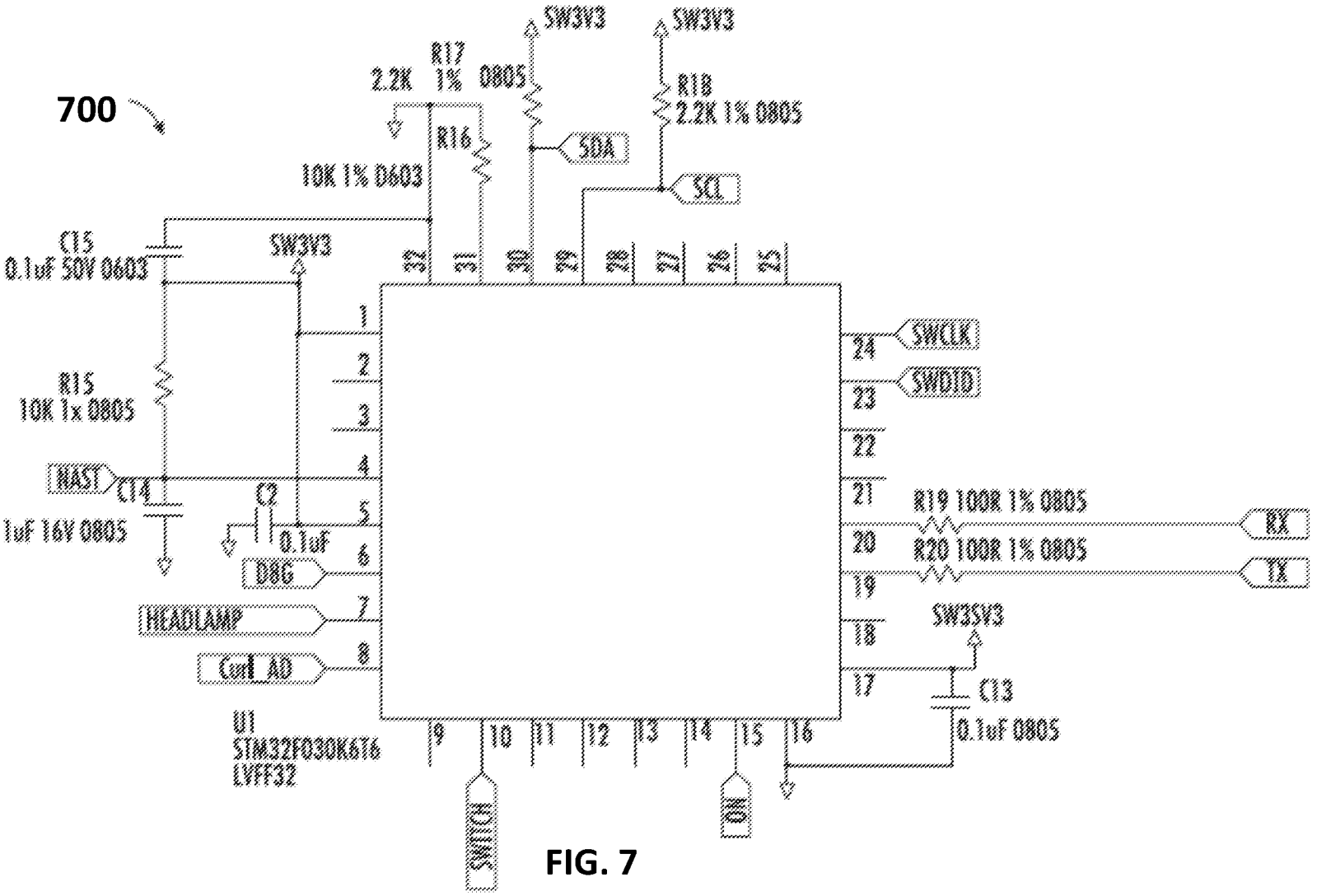
FIG. 7 shows an example schematic diagram of a microcontroller suitable for use in the nozzle controller circuitry of FIG. 1.

Turning briefly to FIGS. 6 and 7 with reference to FIG. 1, FIG. 6 shows an example circuit diagram for a transistor switching circuit 600 suitable for use in the nozzle control circuitry of FIG. 1, and FIG. 7 shows an example schematic diagram of a microcontroller 700 (MCU) suitable for use in the nozzle controller circuitry of FIG. 1, and preferably, suitable for use as the nozzle controller 104.

One example method for transitioning between a standby/sleep mode for the nozzle circuitry 100 and the in-use mode is as follows. Initially when the vacuum moves, e.g., based on a user gripping the handle portion 114 and moving the surface cleaning device101, an accelerometer of the operation sensor(s) 108 sends a signal to the transistor switching circuit 600 (See FIG. 6) to briefly power a microcontroller 700.

The MCU 700 then receives an output value from a pressure sensor of the operation sensor(s) 108 to determine if the output value exceeds a predefined threshold, and thus, if the surface cleaning device 101 is ON and in use by a user. In response to the MCU 700 determining the surface cleaning device 101 is ON, the transistor switching circuit 600 remains high keeping the MCU 700 powered on to transition to the in-use mode. The MCU 700 can then cause one or more of the headlamp(s), diagnostic LEDs, and brushroll motor 112 to turn ON. While ON, the MCU 700 periodically receives output data from the pressure sensor of the operation sensor(s) 108 to confirm values that indicate pressure consistent with usage of the surface cleaning device 101. During the in-use mode, the MCU 700 can utilize an accelerometer of the operation sensor(s) 108, floor detect circuitry (e.g., implemented in the pressure sensor and/or other suitable sensor in combination with a floor detect algorithm) to intelligently control the brush motor mode/RPM relative to the detected floor type.

In response to pressure values falling below the predefined threshold for a predefined period of time (e.g., between 1-20 seconds, and preferably between 1-3 seconds), the transistor switching circuit 600 switches "low" to turn off the MCU 700 and transition to the low-power, standby mode.

In an embodiment, the surface cleaning device 101 initially provides a signal_A to the transistor switching circuit 600 to momentarily enable the MCU 700 (e.g., to wake from sleep/standby mode). The MCU 700 then can sets different signal_B that is OR'd with signal_A, to keep the MCU 700 powered.

The MCU then can sample the operation sensor(s) 108 to determine if the output value indicates the surface cleaning device 101 is ON (e.g., based on a threshold value). If the surface cleaning device 101 is ON, then MCU 700 keeps signal_B on, else it makes signal_B off, therefore transitioning the smart nozzle circuitry back into sleep/standby mode. If the surface cleaning device 101 is detected as ON, then the MCU 700 then tells the headlamps, debug led, and brushroll motor 112 to turn on, for example.

Once the MCU 700 is ON and initialized, the MCU 700 continuously samples the pressure sensor of the operational sensor(s) 108 to determine if the current pressure level indicates the surface cleaning device 101 is ON (e.g., based on a threshold), and if not, then the MCU 700 it sets signal_B off, thereby transitioning the mode to standby.

Additionally, the MCU 700 can use motion sensor data, floor detect circuitry (e.g., established using floor detect algorithm, as discussed above) and the pressure sensor measurements to intelligently control the brush motor mode/RPM. One such example method for intelligently controlling the brush motor mode/RPM is discussed with reference to FIG. 2.

The components of the nozzle control circuitry 100 can be disposed on a single substrate, e.g., a printed circuit board (not shown), and be powered by the nozzle power supply 106 implemented as a 16V lithium Ion battery, for instance. In this case, the 16V output can be fed through a DC-DC converter circuit (not shown) to step down to 12V to power, for instance, the brushroll motor 112. The 12V output of the DC-DC converter circuit can be then fed through another DC-DC converter circuit (not shown) to step down the voltage to a (constant) 3.3V source to supply power to the sensory, such as the operation sensor(s) 108, floor detect circuitry 110, and diagnostic LEDs, for example.

Consistent with the present disclosure, the aforementioned in-use mode can include additional operational features. In an embodiment, the nozzle controller 104 receives acceleration data from the operation sensor(s) 108. When movement in a negative X or Y direction (e.g., indicating the user is pulling the surface cleaning device 101 towards them), exceeds a predefined threshold, the nozzle controller 104 can de-energize the brushroll motor 112 to advantageously reduce strain experienced by the by the user when pulling the surface cleaning device 101 backwards during cleaning operations.

In-Use Detection via Air Pressure Sensor(s)

In an embodiment, the operation sensor(s) 108 include at least one air pressure sensor that gets turned ON (e.g., energized) after the same receives a signal from the nozzle controller 104. The nozzle controller 104 may provide the signal to turn on the at least on air pressure sensor based on, for example, acceleration data received from an accelerometer of the operation sensor(s) 108.

The at least one air pressure sensor can then measure/read pressure values within the surface cleaning device 101 and communicate the pressure values to the nozzle controller 104. When the pressure values are below a first predefined pressure threshold value (or a minimum pressure value) that indicates the surface cleaning device 101, and in particular the suction motor 122, is OFF, the nozzle controller 104 then causes the brushroll motor 112 to de-energize and turn OFF. On the other hand, if the pressure value is above a second predefined pressure threshold value (or a maximum pressure value), the nozzle controller 104 can determine/detect that the surface cleaning device 101 is ON/in-use. Thus, the nozzle controller 104 can determine that the surface cleaning device 101 is in use (or not, as the case may be) via a plurality of different threshold pressure values.

In an embodiment, the nozzle controller 104 communicates with the pressure sensor at a relatively high-frequency so that the nozzle controller 104 can monitor that the surface cleaning device 101 remains ON/in-use and initiate timely transition between the in-use and standby power modes. In this embodiment, the pressure sensor of the operation sensor(s) 108 may be used exclusively, or in combination with other sensors of the operation sensor(s) 108, e.g., an accelerometer, to identify whether the surface cleaning device 101 is an ON (e.g., in-use) or in an OFF (e.g., storage/standby) mode. The speed (RPM) at which the brushroll motor 112 operates the brushroll(s) can be controlled via the nozzle controller 104, or preferably, based on the floor detect circuitry 110.

The following hand-held surface cleaning device states (modes) may be detected by the nozzle controller 104, and operation of the nozzle 102 may be adjusted accordingly. The nozzle controller 104 preferably detects a high suction mode (or bare floor mode), when a pressure sensor of the operation sensor(s) 108 indicates a pressure value above a predefined threshold and/or when the floor detect circuitry 110 detects presence of a bare floor. In this mode, the nozzle controller 104 may adjust the RPM of the brushroll(s) preferably to zero RPMs.

Conversely, the nozzle controller 104 preferably detects a low suction mode, or carpet mode, based on the pressure sensor indicating a pressure value below the predefined threshold and/or the floor detect circuitry 110 detects the presence of carpet. In this mode, the nozzle controller 104 may then adjust the RPM of the brushroll(s), and preferably increase RPMs to a predetermined rate relative to the bare floor mode. Note, the predefined threshold for the high suction mode (or bare floor mode) and the low suction mode (or carpet mode) may be the same, or different, depending on a desired configuration.

Figure 2:
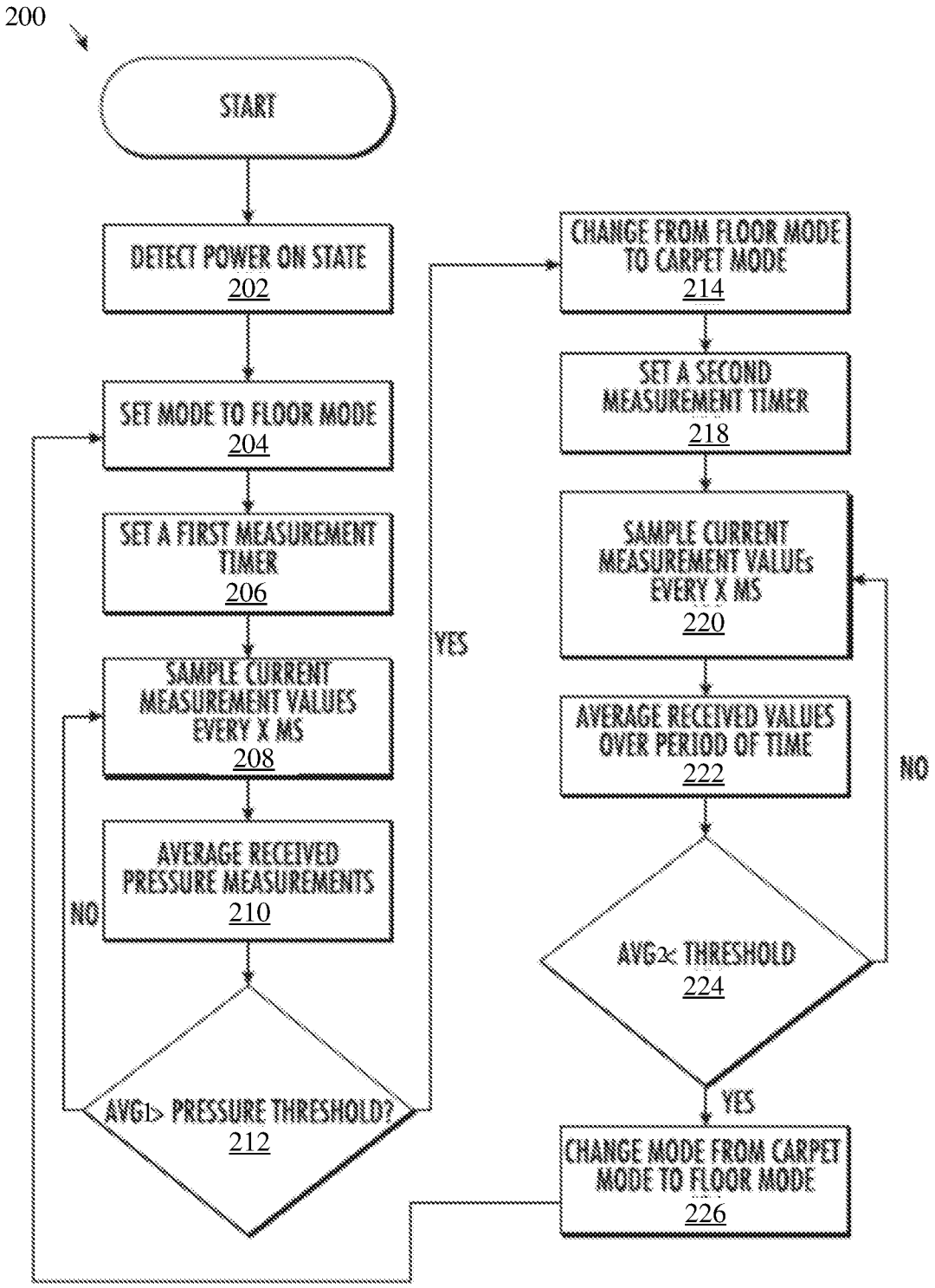
FIG. 2 shows an example method for controlling brushroll speed in accordance with an embodiment of the present disclosure.

FIG. 2 shows an example method 200 for detecting a floor type by monitoring current across the brushroll motor 112.

The monitoring/measurements of the current drawn by the brushroll motor 112 may be performed by the nozzle controller 104 or other suitable circuitry, and preferably, circuitry disposed within the nozzle 102. When the surface cleaning device 101 transitions to the in-use mode, the nozzle controller 104 can preferably utilize an on-board ADC or other suitable circuitry and amplify and convert a measured electrical current drawn by the brushroll motor 112 into a proportional voltage. Then, the amplified and converted voltage can be provided to the nozzle controller 104. The nozzle controller 104 may then monitor the amplified and converted voltage via method 200. The nozzle controller 104 can be configured to execute the method of FIG. 2, although other components can perform one or more acts of method 200.

In act 202, the nozzle controller 104 detects the surface cleaning device 101 is in use. As discussed above, usage of the surface cleaning device 101 can be determined by detecting that the suction motor 122 is generating suction and/or via acceleration data, for example. The nozzle control circuitry 100 can thus transition to the in-use mode based on detecting usage of the surface cleaning device 101. Other approaches to detecting usage of the surface cleaning device 101 are also applicable and this disclosure is not intended to be limited in this regard. For instance, non-limiting alternatives include wireless communication (WIFI™, BLUETOOTH™ low energy, NFC) between the nozzle control circuitry and the vacuum controller circuitry 118, vibration measurements and/or sound measurements.

In act 204 the nozzle controller 104 sets the current mode for the nozzle to FLOOR mode (also referred to herein as a bare floor mode). FLOOR mode includes an associated RPM, which the nozzle controller 104 can determine via a look-up table in a memory, for example. The nozzle controller 104 therefore sets the current mode to the FLOOR mode by driving the brushroll motor 112 to rotate at the associated RPM. In an embodiment, the FLOOR mode is between 0 and 100% of potential RPM speed, and preferably, zero (0) RPMs.

In act 206, a first measurement timer is set. In act 208, the nozzle controller 104 receives a plurality of electrical current measurements for the period of time defined by the first measurement timer. By way of example, the first measurement timer may be set to 1200 milliseconds. In the event the timer elapses, the method 200 can transition the nozzle from FLOOR mode to OFF and optionally return to act 202.

In act 208, the nozzle controller 104 receives a plurality of electrical current measurement values. For instance, the nozzle controller 104 can receive up to at least five (5) measurement values by sampling at a rate of 40 ms. Thus, at 200 ms, the nozzle controller 104 can have 5 current measurement values in this example, although other sampling rates are within the scope of this disclosure. Preferably, the sampling rate is at least 40 ms, and more preferably, at least 100 ms.

In act 210, the nozzle controller 104 averages the received plurality of current measurements to produce a first current average (AVG1). In act 212, the nozzle controller 104 determines if the first current average (AVG1) exceeds a first predefined threshold. If the first current average (AVG1) exceeds the first predefined threshold, the method 200 continues to act 214, if not, the method 200 returns to act 204 and continues to perform acts 204-212.

In act 214, the nozzle controller 104 transitions the mode from FLOOR MODE to CARPET MODE. Transitioning to the CARPET MODE can further include the nozzle controller 104 driving the brushroll motor 112 at an associated RPM, the associated RPM of the CARPET MODE being greater than the associated RPM of the FLOOR MODE.

In act 218, the first measurement timer is optionally cancelled (or disabled), and a second measurement timer is set. The duration of the second measurement timer may be less than that of the duration of the first measurement timer. For instance, the second measurement timer may be set to 700 ms, or another value. Preferably, the second measurement timer is 500 ms or less.

In act 220, the nozzle controller 104 samples the electrical current drawn by the brushroll motor 112 every X ms, e.g., 40 ms or less. In act 222, the nozzle controller 104 averages the current measurement values to determine a second current average (AVG2). In act 224, the nozzle controller 104 determines if the second current average (AVG2) is less than a predefined threshold, and if so, the method continues to act 226. Otherwise, the method 200 returns to act 220 and continues to perform acts 220-224. In act 226, the nozzle controller 104 transitions the mode from carpet mode to floor mode, and the method 200 then continues to act 204.

Thus, nozzle control circuitry is disclosed herein that can include a separate battery from an associated hand-held vacuum and can be independently powered and operated from the hand-held vacuum to eliminate wires/interconnects extending through the hand-held vacuum to the nozzle. Preferably, a pressure sensor is used to determine the operation mode of the surface cleaning device based on detecting the presence of suction generated by a suction motor.

Preferably, the nozzle controller 104 uses acceleration data to determine the forward/backward motion of the nozzle 102. When detecting backward motion, the speed of the brushroll may be reduced or increased by the nozzle controller 104 to reduce drag friction that causes tiring of user arms. Alternatively, or in addition, the direction of rotation of the brush roll(s) may be changed such that the brushrolls(s) "pull" the surface cleaning device 101 in a direction generally corresponding to the direction of travel desired by the user. Preferably, output data from an accelerometer can also be used to determine the forward/backward motion of the nozzle 102, and the nozzle controller 104 will preferably conserve battery run-time by reducing the nozzle speed based on direction of motion (e.g. in the back stroke). In addition, the nozzle controller 104 can utilize a pressure sensor to determine a clog in the system and can alert the user to service the clog. Such clog determination can be based on measured pressure vs a look-up of expected pressure.

Figure 3C:
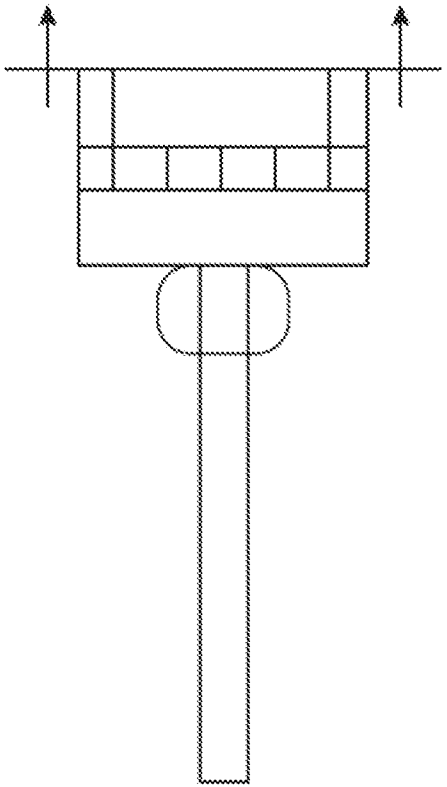
FIG. 3C shows another example approach to detecting the presence of a wall using acceleration data, in accordance with an embodiment of the present disclosure.
Figure 3B:
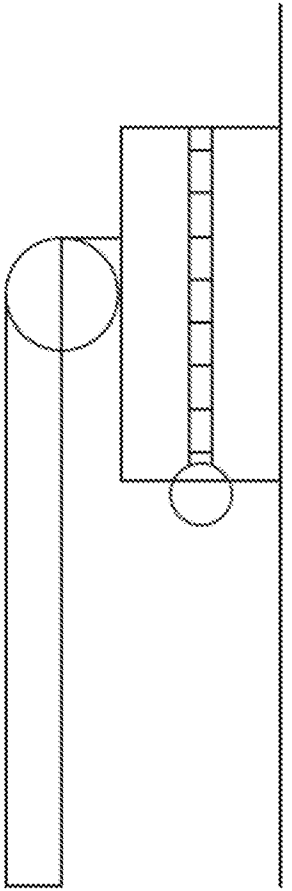
FIG. 3B shows an example approach to utilizing acceleration and/or orientation to detect when a surface cleaning device traverses a wall or other vertical surface, in accordance with an embodiment of the present disclosure.
Figure 3A:
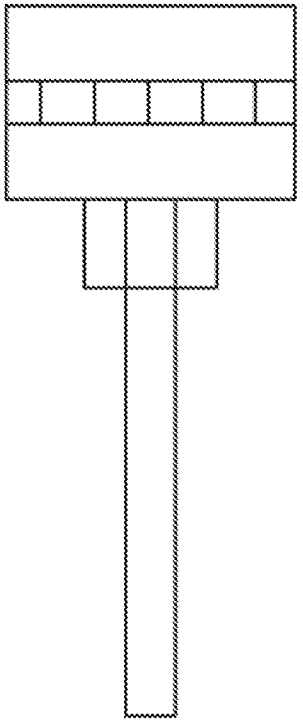
FIG. 3A shows an example approach to utilizing detected velocity to adjust brushroll rotations per minute (RPM) in accordance with an embodiment of the present disclosure.

FIGS. 3A-3C show additional aspects of a nozzle consistent with the present disclosure. As shown, the accelerometer data can be used to identify a "backstroke" whereby a user pulls the nozzle towards themselves, such as shown in FIG. 3A. In response, the nozzle can reduce brushroll speed to reduce friction introduced by the same to decrease user fatigue. Also, accelerometer/gyro data can be utilized to detect when a nozzle traverses a vertical or substantially vertical surface such as a wall, such as show in FIG. 3B. In addition, and as shown in FIG. 3C, a nozzle consistent with the present disclosure can detect contact with a wall, e.g., based on sudden deceleration, and may modify brushroll and/or wheel speed to reduce the amount of user force necessary to draw the nozzle away from the wall to continue cleaning operations.

Figure 4:
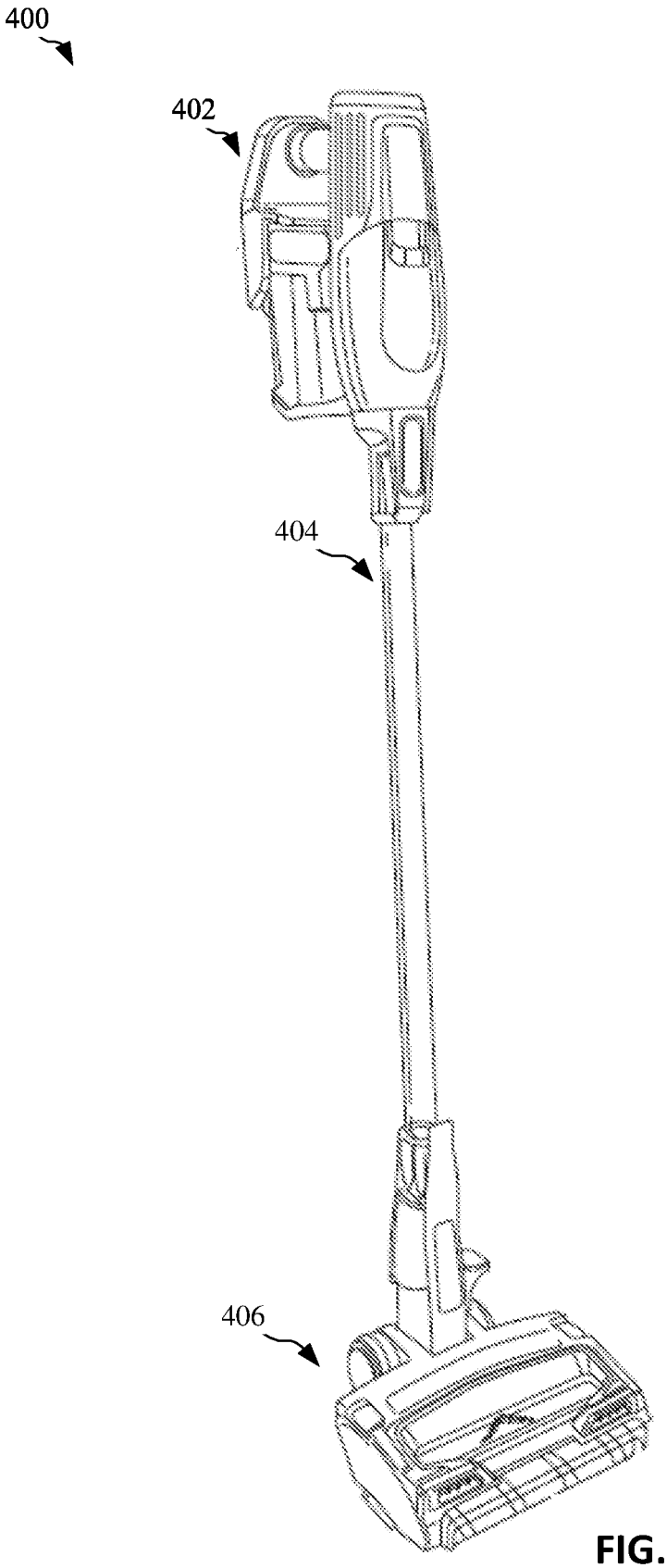
FIG. 4 shows an example surface cleaning device implementing nozzle control circuitry consistent with the present disclosure.

FIG. 4 shows an example surface cleaning device 400 implementing nozzle control circuitry consistent with the present disclosure. As shown, the example surface cleaning device 400 includes a body 402 coupled to a nozzle 406 via a wand 404. The nozzle 406 can implement the nozzle control circuitry 100 as discussed above.

Figure 5A:
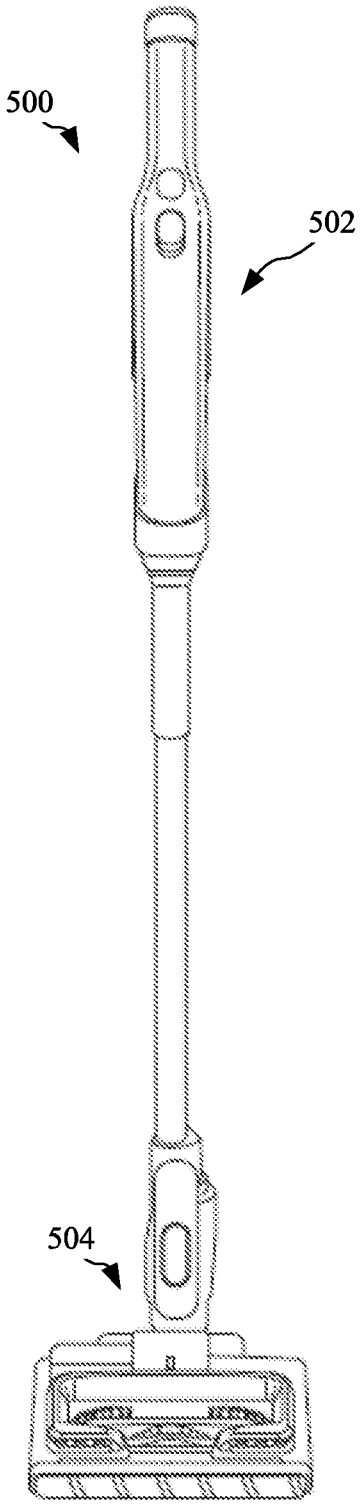
FIGS. 5A-5B show another example surface cleaning device implementing nozzle control circuitry consistent with the present disclosure.
Figure 5B:
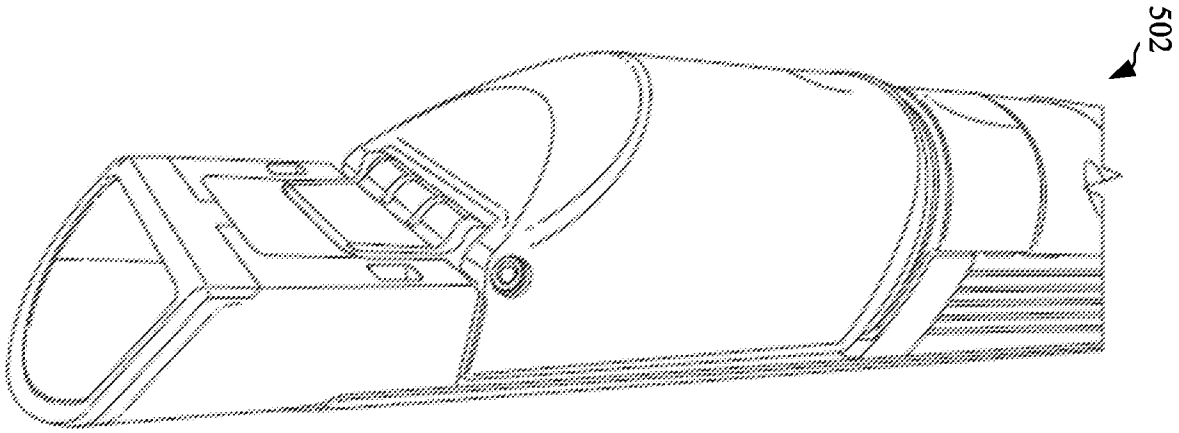

FIGS. 5A-5B show another example surface cleaning device 500 implementing nozzle control circuitry consistent with the present disclosure. As shown, the example surface cleaning device 500 includes a wandvac 502 that removably couples to a nozzle 504. The nozzle 504 can implement the nozzle control circuitry 100 as discussed above.

In one preferred example, accelerometer data may be used to determine if the nozzle 102 is cleaning near a wall by sensing "bumping" and may cause change to the brushroll speed or cause a different side brush motor to turn on to optimize side cleaning.

Table 1 shows various user operations using nozzle control circuitry consistent with the present disclosure and the resulting action and intended benefits.

TABLE 1

| User Operation | Trigger/ Stimuli | Operational Result | Benefit |
|---|---|---|---|
| Backstroke | Velocity | Change: Brush roll speed; Suction force; Light Intensity; Articulate rear bristle strip; and/or front edge shutter | Less resistance pull-force on operators hand. Reduced energy consumption resulting in increased run-time (particularly important for cordless products) Communicate Intelligent Behavior and energy conservation. Improved cleaning on backstroke. |
| Traversing a wall/ object | Velocity | Articulated side brushes/side edges Airflow Directivity Change: Brush roll speed; Suction force; and/or Light intensity | Better edge cleaning. Communicate Intelligent Behavior and Energy Conservation. |
| Hitting a baseboard (front strike) | Acceleration/ Deceleration | Change: Brush roll speed; Suction Force; and/or Articulate Frontedge Shutter. | Better front edge cleaning. |
| Surface type detection | Acceleration/ Deceleration | Change: Brushroll speed; and/or Suction force. | Optimized speed/suction for better cleaning on any floor type. |
| User interaction style detection | Acceleration/ Deceleration | Change: Brush roll speed; and/or Suction force. | Customized speed/suction for better cleaning. |

In accordance with an aspect of the present disclosure a surface cleaning device is disclosed. The surface cleaning device comprising a body defining a handle portion and a dirty air passageway, a suction motor for generating suction to draw air into the dirty air passageway, a nozzle coupled to the body and having a dirty air inlet fluidly coupled with the dirty air passageway, a sensor coupled to the nozzle, a brushroll motor to drive one or more brush rolls, and nozzle control circuitry, the nozzle control circuitry to detect usage of the surface cleaning device based on output data from the sensor and, in response to receiving the output data, cause the brushroll motor to energize.

In accordance with another aspect of the present disclosure a hand-held surface cleaning device is disclosed. The hand-held surface cleaning device comprising a body defining a handle portion and a dirty air passageway, a suction motor for generating suction to draw dirt and debris into the dirty air passageway, a nozzle coupled to the body and having a dirty air inlet fluidly coupled with the dirty air passageway, the nozzle defining a cavity, a brushroll motor to drive one or more brush rolls within the cavity of the nozzle, and nozzle control circuitry disposed in the cavity of the nozzle, the nozzle control circuitry to detect usage of the hand-held surface cleaning device during a cleaning operation, and in response to detecting the usage of the hand-held surface cleaning device, sending a driving signal to the brushroll motor to cause the brushroll motor to rotate the one or more brush rolls at a predetermined rotations per minute (RPM).

In accordance with another aspect of the present disclosure a method for controlling brushroll speed within a surface cleaning device is disclosed. The method comprising detecting, by a controller, a suction motor is generating suction to draw dirt and debris into an inlet of the surface cleaning device, in response to detecting suction generated by the suction motor, energizing a portion of a nozzle control circuit for detecting a floor type adjacent the inlet of the surface cleaning device, and sending a driving signal to a brushroll motor to adjust rotations per minute (RPM) of one or more associated brush rolls based on the detected floor type.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present disclosure, which is not to be limited except by the claims.

What is claimed is:

1. A surface cleaning device comprising:

a body defining a handle portion, a dirty air passageway, and a cavity to receive vacuum controller circuitry, the vacuum controller circuitry including:
- a primary controller;
- a primary power supply; and
- a suction motor for generating suction to draw air into the dirty air passageway;

a nozzle removably coupled to the body and having a dirty air inlet configured to fluidly couple with the dirty air passageway, the nozzle including nozzle control circuitry that is electrically isolated from the vacuum controller circuitry, the nozzle control circuitry having:
- a brushroll motor to drive one or more brush rolls;
- an accelerometer configured to generate a motion signal corresponding to motion data in response to movement of the nozzle;
- a pressure sensor configured to generate a pressure signal corresponding to pressure data in response to pressure within the nozzle;
- a secondary power supply; and
- a secondary controller configured to:
  - detect initial usage of the surface cleaning device prior to activation of the suction motor and the brushroll motor based, at least in part, on the motion signal corresponding to motion data;

in response to detecting the initial usage and prior to activation of the suction motor and the brushroll motor, begin monitoring the pressure signal corresponding to pressure data;

after detecting the initial usage, detect activation of the suction motor based, at least in part, on the pressure signal corresponding to pressure data indicating a change in pressure; and in response to detecting the activation of the suction motor, send a driving signal to the brushroll motor, the driving signal causing the brushroll motor to rotate the one or more brush rolls.

2. The surface cleaning device of claim 1, wherein the nozzle control circuitry de-energizes the secondary controller based on the pressure signal corresponding to pressure data indicating an amount of detected suction is below a predefined threshold.

3. The surface cleaning device of claim 1 further comprising at least one of:

a force sensor to detect an amount of force supplied by the nozzle against a surface to be cleaned; or an orientation sensor to detect an orientation of the surface cleaning device relative to the surface to be cleaned.

4. The surface cleaning device of claim 1, wherein the nozzle control circuitry causes the one or more brush rolls to rotate at a predetermined rotations per minute (RPM).

5. The surface cleaning device of claim 4, wherein the surface cleaning device further comprises a floor type sensor and the nozzle control circuitry causes the brushroll motor to drive the one or more brush rolls at the predetermined RPM based on output from the floor type sensor.

6. The surface cleaning device of claim 1, wherein the nozzle control circuitry causes the brushroll motor to drive the one or more brush rolls at a predetermined rotations per minute based on the motion signal corresponding to motion data generated by the accelerometer.

7. A hand-held surface cleaning device comprising:

a body defining a handle portion, a dirty air passageway, and a cavity to receive vacuum controller circuitry, the vacuum controller circuitry including:

a primary controller;

a primary power supply; and a suction motor for generating suction to draw dirt and debris into the dirty air passageway; and a nozzle removably coupled to the body and having a dirty air inlet configured to fluidly couple with the dirty air passageway, the nozzle including nozzle control circuitry that is electrically isolated from the vacuum controller circuitry, the nozzle control circuitry having:

a brushroll motor to drive one or more brush rolls;

an accelerometer configured to generate a motion signal corresponding to motion data in response to movement of the nozzle;

a pressure sensor configured to generate a pressure signal corresponding to pressure data in response to pressure within the nozzle;

a light source;

a secondary power supply; and a secondary controller configured to:

detect initial usage of the hand-held surface cleaning device prior to activation of the suction motor and the brushroll motor based, at least in part, on the motion signal corresponding to motion data;

in response to detecting the initial usage and prior to activation of the suction motor and the brushroll motor, begin monitoring the pressure signal corresponding to pressure data and energize the light source;

after detecting the initial usage, detect activation of the suction motor based, at least in part, on the pressure signal corresponding to pressure data indicating a change in pressure; and in response to detecting the activation of the suction motor, send a driving signal to the brushroll motor to cause the brushroll motor to rotate the one or more brush rolls at a predetermined rotations per minute (RPM).

8. The hand-held surface cleaning device of claim 7 further comprising at least one of:

a force sensor to detect a force value indicating contact between the nozzle and a surface to be cleaned; or an orientation sensor to detect an orientation of the hand-held surface cleaning device relative to the surface to be cleaned.

9. The hand-held surface cleaning device of claim 7, wherein the secondary controller causes the brushroll motor to change RPM of the one or more brush rolls based on the motion data.

10. The hand-held surface cleaning device of claim 7, wherein the nozzle control circuitry includes a floor type detector and the nozzle control circuitry causes the brushroll motor to adjust RPM of the one or more brush rolls based on output from the floor type detector.

11. A surface cleaning device comprising:

a body including a dirty air passageway and a cavity to receive vacuum controller circuitry, the vacuum controller circuitry including:

a primary controller;

a primary power supply; and a suction motor for generating suction to draw air into the dirty air passageway;

a nozzle configured to removably couple to the body and having a dirty air inlet configured to fluidly couple with the dirty air passageway, the nozzle including nozzle control circuitry that is electrically isolated from the vacuum controller circuitry, the nozzle control circuitry including:

a brushroll motor to drive one or more brush rolls;

an accelerometer configured to generate a motion signal corresponding to motion data in response to movement of the nozzle;

a pressure sensor configured to generate a pressure signal corresponding to pressure data that is indicative of an air pressure within the nozzle;

a secondary power supply; and a secondary controller configured to transition between a low-power mode and an in-use mode based, at least in part, on the motion signal corresponding to motion data, wherein:

when in the low-power mode, the suction motor and the brushroll motor are inactive, and the secondary controller is configured to:

monitor the motion signal corresponding to motion data to detect motion of the nozzle that corresponds to initial usage; and in response to detecting the initial usage, transition to the in-use mode; and when in the in-use mode the secondary controller is configured to:

monitor the pressure signal corresponding to pressure data prior activating the brushroll motor;

detect activation of the suction motor prior to activating the brushroll motor based, at least in part, on the pressure signal corresponding to pressure data indicating a change in pressure; and in response to detecting the activation of the suction motor, activating the brushroll motor such that the one or more brushrolls begin rotating.

12. The surface cleaning device of claim 11, wherein the motion signal corresponding to motion data is monitored at a first sample rate and the pressure signal corresponding to pressure data is monitored at a second sample rate, the second sample rate being greater than the first sample rate.

13. The surface cleaning device of claim 11, wherein, when in the low-power mode, the motion signal corresponding to motion data is monitored without the pressure signal corresponding to pressure data being monitored.

* * * * *